US006009844A

United States Patent [19]

Stumpp et al.

[11] Patent Number: 6,009,844

[45] Date of Patent: Jan. 4, 2000

[54] CAST CYLINDER HEAD AND METHOD FOR MANUFACTURING SAME

[75] Inventors: Georg Stumpp, Ludwigsburg; Arnold Kaden, Remshalden; Jochen Betsch, Waiblingen, all of Germany

[73] Assignee: DaimlerChrysler, Germany

[21] Appl. No.: 09/133,428

[22] Filed: Aug. 13, 1998

[30] Foreign Application Priority Data

Aug. 13, 1997 [DE] Germany ..... 197 35 012

[51] Int. Cl.[7] ..... F02F 1/40

[52] U.S. Cl. ..... 123/193.5; 123/41.82 R

[58] Field of Search ..... 123/193.5, 193.3, 123/41.82 R

[56] References Cited

U.S. PATENT DOCUMENTS 3,165,095 1/1965 Adler ..... 123/41.82 R 4,690,104 9/1987 Yasukawa ..... 123/41.82 R

OTHER PUBLICATIONS

Patent Abstracts of Japan, vol. 006, No. 033, Feb. 27, 1982, JP 56–148647 A, Nakamura Takeshi, Nov. 18, 1981.

*Primary Examiner*—Marguerite McMahon

*Attorney, Agent, or Firm*—Evenson, McKeown, Edwards & Lenahan, P.L.L.C.

[57] ABSTRACT

A method for manufacturing a cast cylinder head for an internal combustion engine in a casting mold includes placing a sand core in a casting mold in a cavity between an upper part and a lower part of the mold to form a water chamber. Before casting, a displacement body is placed in the sand core, and the displacement body remains in the water chamber after casting.

13 Claims, 2 Drawing Sheets

CAST CYLINDER HEAD AND METHOD FOR MANUFACTURING SAME

BACKGROUND AND SUMMARY OF THE INVENTION

This application claims the priority of German Patent Application No. 197 35 012.7, filed Aug. 13, 1997, the disclosure of which is expressly incorporated by reference herein.

The present invention relates to a method for manufacturing a cast cylinder head for an internal combustion engine, as well as a cast cylinder head of an internal combustion engine.

According to known practice, cylinder heads are manufactured almost exclusively by casting. Usually, casting molds are used whose outer margins are formed by casting dies, made of steel for example. To form inlet and outlet channels as well as a space for the cooling water in the cylinder head (i.e., the so-called water chamber), sand cores made of casting sand are suspended in the casting dies.

Following the casting process, the sand cores are initially mechanically comminuted and then usually blown out of the hollow spaces thus formed in the cylinder head, using compressed air. As a result of various parameters required in casting technology, such as parting planes for example, drafts, or casting wall thicknesses, it is not possible to design the water chamber freely. As a result, optimum cooling of the combustion chambers located in the lower area of the cylinder head by the cooling water cannot be achieved.

The poor cooling of the combustion chambers is also caused by the fact that as a result of the cooling water being added from a crankcase located beneath the cylinder head, the cooling water already has a powerful momentum toward the upper area of the water chamber. In addition, accumulations of castings should always be avoided in cast parts, so that the water chamber must be designed very much larger than necessary in the cylinder head.

U.S. Pat. No. 4,690,104 describes a cylinder head manufactured by casting for an internal combustion engine that has an opening in the upper area into which a cup-shaped part is screwed. The cooling water stream is intended to be conducted through this part toward the combustion chambers, with the opening simultaneously being used to remove the casting sand.

However, the relatively cumbersome screwing in of the cup-shaped part is disadvantageous, with additional sealing devices being required in order to seal off the water chamber of the cylinder head reliably. In addition, in this cylinder head, considerable mechanical effort is required to make a very large threaded bore for the cup-shaped part.

A cylinder head is disclosed in British Patent No. 563,789 that is provided with a cover plate on its upper side that is held in place by bolts. On the side of the cover plate that faces the interior of the cylinder head, a distributor plate is fastened by additional bolts, with this distributor plate being intended to ensure that the cooling water flowing through the cylinder head is located for the most part in the vicinity of the combustion chambers.

The goal of the present invention is to provide a method for manufacturing a cylinder head that makes it possible by very simple means for the coolant contained in a water chamber of the cylinder head to cool very well, especially to cool the combustion chambers located in the lower area of the cylinder head.

According to the present invention, a displacement body, which remains in the water chamber of the cylinder head, produces an improved distribution of the flow of coolant in the cylinder head, especially a concentration of the coolant stream at the tops of the combustion chambers located in the lower part of the cylinder head.

This improved cooling advantageously results in a reduction in the power of a water pump, lower fuel consumption, and a higher tolerance for knocking.

Another advantage of the displacement body located in the water chamber is that the quantity of coolant in the internal combustion engine can be reduced considerably as a result. This reduction results in a shorter warm-up phase for the engine so that pollutant emissions and frictional work are reduced, while driving comfort, heating response, and rate of defrosting and defogging of the windows are increased.

The displacement body according to the present invention offers another positive aspect by virtue of the fact that it can contribute to stiffening the cylinder head.

Moreover, a large quantity of casting sand can be saved as a result of the displacement body being located in the sand core.

Other objects, advantages and novel features of the present invention will become apparent from the following detailed description of the present invention when considered in conjunction with the accompanying drawings.

DETAILED DESCRIPTION OF THE DRAWINGS

Figure 1:
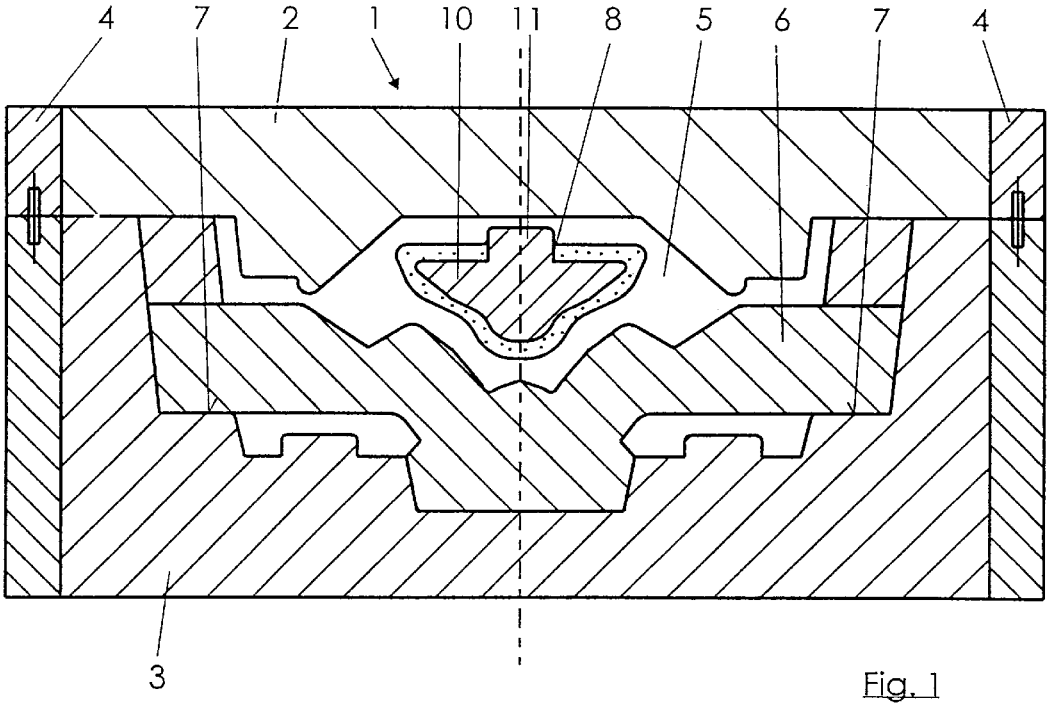
FIG. 1 is a section through a casting mold for a cylinder head according to the present invention, with a displacement body in the vicinity of the inlet and outlet channels.

FIG. 1 shows a casting mold 1 which is composed in known fashion of an upper part 2 and a lower part 3. At its outer edge, casting mold 1 is delimited by a mold box 4. Upper part 2 and lower part 3 are designed as casting dies. Mold box 4 is made of metal, steel for example.

A cavity 5 is formed between upper part 2 and lower part 3, the cavity forming the cylinder head after the casting process. The section shown in FIG. 1 through casting mold 1 also shows a sand core 6 which forms inlet and outlet channels after the casting process. Sand core 6 is placed in core supports or mounts 7 located in lower part 3.

To form a water chamber after the casting process, an additional sand core 8 is located in cavity 5. As can be seen from FIG. 2, sand core 8 is likewise placed in core mounts 9, located in lower part 3.

A displacement body 10 is machined into sand core 8 before the casting process. This is achieved by virtue of the fact that the displacement body 10 is sanded before insertion of sand core 8 and thus sand core 8 is created for the first time. The casting sand of sand core 8, depending on the material used for displacement body 10, has a corresponding insulating effect in order to prevent melting and/or evaporation of displacement body 10 during the casting process.

Displacement body 10 has mounting areas 11 located in the immediate vicinity of core mounts 9. Mounting areas 11 can also be located at any point in the cylinder head in order to create a connection with the remainder of the cylinder head. By means of mounting areas 11, displacement body 10 is initially secured in a manufacturing mold (not shown) for sand core 8. After casting, mounting areas 11 serve for connection with the remainder of the cylinder head. Mounting areas 11 are melted on during the casting process by the liquid material which flows into cavity 5 through feeds, not shown. As a result, a permanent connection and hence an immobilization of displacement body 10 is produced by the material that flows into cavity 5 during the casting process.

By securing displacement body 10 by means of mounting areas 11 in the form of sealing disks in the mold manufacturing for sand core 8, during the subsequent casting process, openings for core mounts 9 can be sealed during the casting process. In this way, by eliminating the core mount closures, additional cost advantages are realized in each cylinder head. In addition, additional sealing from the outside can be eliminated since the water chamber is sealed off by mounting areas 11.

Displacement body 10 itself can be manufactured very simply and economically from a two-part or multipartite form, not shown, by stamping or casting for example. The casting process using sand core 8 can be performed in known fashion despite its novel design. Displacement body 10 even stabilizes the otherwise very breakage-prone sand core 8.

Figure 3:
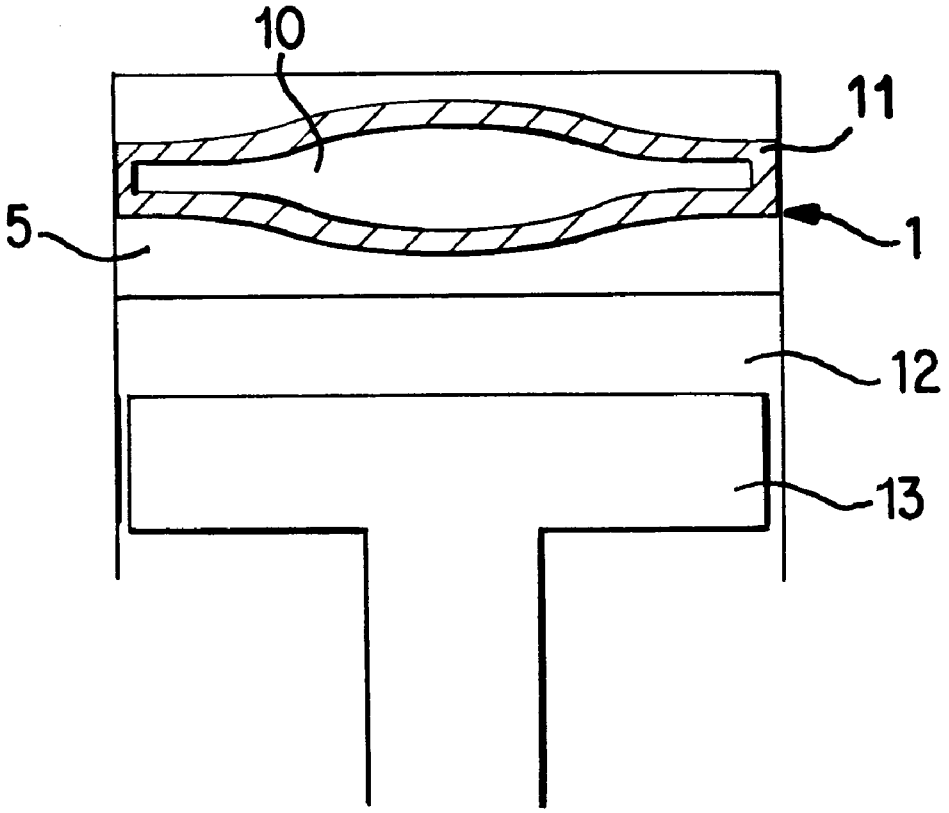
FIG. 3 is a schematic representation of the cylinder head attached to a cylinder in an engine.

The water chamber that results following mechanical removal of sand core 8 has a considerably reduced volume by comparison with known water chambers, since displacement body 10 remains in the water chamber when the cylinder head is finished. FIG. 3 shows water chamber 11 with displacement body 10 in the cylinder head attached to cylinder 12 with piston 13 of an engine.

The coolant is guided by displacement body 10 toward combustion chambers located in the lower part of the cylinder head, the combustion chambers being produced, like the inlet and outlet channels, after sand core 6 is removed.

Depending on the nature of the material used for displacement body 10, with an aluminum alloy usually being used for the purpose, the rigidity and strength of the cylinder head can be increased significantly. The compressive and tensile stresses in the cylinder head can be developed as a function of the type of material used and the casting temperature associated therewith. This is achieved by the material in cavity 5 as it cools, shifting displacement body 10. Thus it is possible to compensate for stresses that develop during later operation of the cylinder head by suitably chosen preliminary pressure and/or tension stresses. Displacement body 10 can also contain structural elements such as posts or ribs to stiffen the cylinder head.

Figure 2:
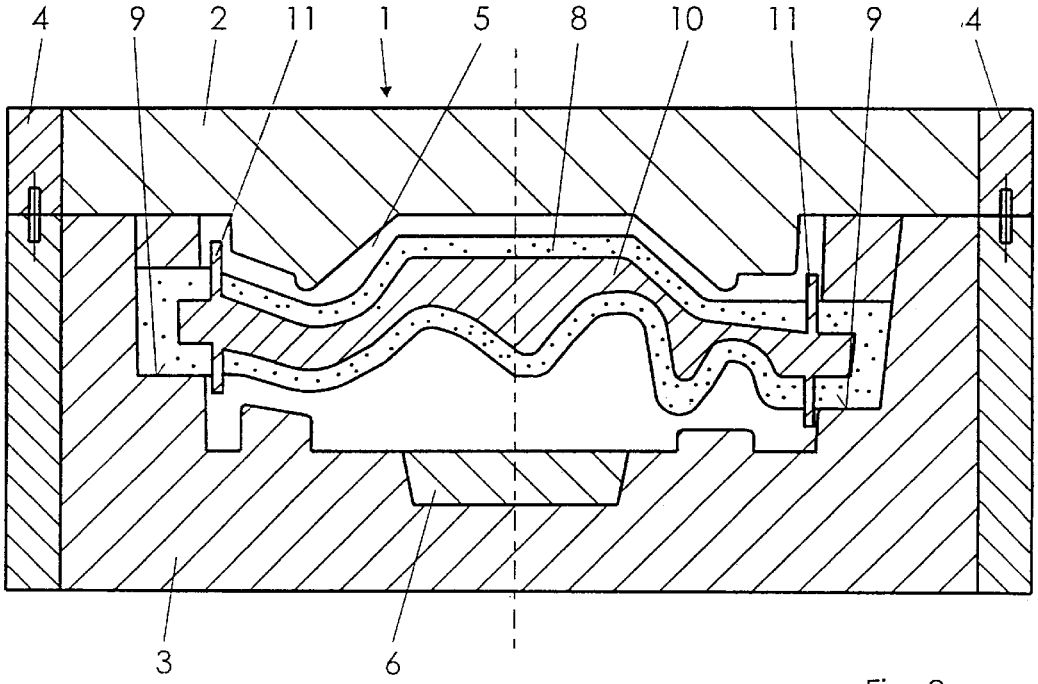
FIG. 2 is another section through the casting mold for the cylinder head with the displacement body from FIG. 1.

Displacement body 10 shown in FIGS. 1 and 2 has a shape suitable for the cooling water conditions in the water chamber, but in embodiments that are not shown, for further optimization of the flow, it is possible to imagine both lattice-spoiler configurations with massive ribs on displacement body 10 as well as a displacement body 10 with a very simple design.

In an embodiment that is not shown, displacement body 10 can consist of a material with a lower density than the coolant, so that displacement body 10, after the internal combustion engine is filled with coolant, is located freely floating in the upper area of the water chamber as a result of the lifting forces that result. It is therefore possible to mount spacers on the top of hollow chamber 5 or on the top of displacement body 10 so that coolant flow is still possible even in the upper area of the water chamber. Most of the coolant however is concentrated as described above on the hot walls of the combustion chambers.

The foregoing disclosure has been set forth merely to illustrate the present invention and is not intended to be limiting. Since modifications of the disclosed embodiments incorporating the spirit and substance of the present invention may occur to persons skilled in the art, the present invention should be construed to include everything within the scope of the appended claims and equivalents thereof.

What is claimed is:

1. A method for manufacturing a cast cylinder head for an internal combustion engine, comprising:

adding a displacement body to a sand core;

placing the sand core in a casting mold having a cavity between an upper part and a lower part to form a water chamber for the cylinder head;

casting the cylinder head; and removing the sand core while maintaining the displacement body in the water chamber.

2. The method for manufacturing a cast cylinder head according to claim 1, wherein said adding comprises sanding the displacement body with casting sand.

3. The method for manufacturing a cast cylinder head according to claim 1, further comprising placing the sand core in at least one core mount.

4. The method for manufacturing a cast cylinder head according to claim 1, further comprising bonding the displacement body with the material of the cylinder head at fixed mounting areas during said casting.

5. The method for manufacturing a cast cylinder head according to claim 4, wherein the mounting areas are located in the immediate vicinity of the at least one core mount.

6. The method for manufacturing a cast cylinder head according to claim 1, wherein the displacement body floats in the water chamber after addition of a coolant.

7. A cast cylinder head for an internal combustion engine, comprising:

a water chamber formed by a sand core; and a displacement body located in the water chamber, the displacement body being introduced into the sand core during casting.

8. The cast cylinder head according to claim 7, further comprising mounting areas that are formed on the displacement body as sealing disks.

9. The cast cylinder head according to claim 7, wherein the displacement body floats in the water chamber.

10. The cast cylinder head according to claim 9, further comprising spacers mounted on the top of a hollow chamber or on the top of the displacement body.

11. The cast cylinder head according to claim 7, wherein the displacement body is a spoiler for a flow of coolant in the water chamber.

12. The cast cylinder head according to claim 7, wherein the displacement body further comprises posts or ribs to stiffen the cylinder head.

13. The cast cylinder head according to claim 7, wherein the displacement body comprises an aluminum alloy.

* * * * *